United States Patent [19]

Kun et al.

[11] 4,023,618

[45] May 17, 1977

[54] HEAT EXCHANGER HEADERING ARRANGEMENT

[75] Inventors: Leslie C. Kun, Williamsville; Kit F. Burr, Clarence Center, both of N.Y.

[73] Assignee: Union Carbide Corporation, New York, N.Y.

[22] Filed: Aug. 18, 1975

[21] Appl. No.: 605,420

[52] U.S. Cl. ..... 165/175; 29/157.4; 165/76; 165/152

[51] Int. Cl.[2] ..... F28F 9/16

[58] Field of Search ..... 165/151, 152, 153, 76, 165/173, 175; 29/157.4

[56] References Cited

UNITED STATES PATENTS

| | | | |
|---|---|---|---|
| 1,602,811 | 10/1926 | Clingaman | 165/151 |
| 2,539,701 | 1/1951 | Przyborowski | 165/152 |
| 2,599,965 | 1/1952 | Young | 165/151 X |
| 3,605,882 | 9/1971 | Smith et al. | 29/157.4 X |
| 3,739,840 | 6/1973 | Jones | 29/157.4 X |
| 3,757,855 | 11/1973 | Kun et al. | 165/152 X |
| 3,757,856 | 11/1973 | Kun | 165/152 X |
| 3,775,972 | 12/1973 | Perpall | 165/173 X |
| 3,810,509 | 5/1974 | Kun | 165/153 X |
| 3,845,814 | 11/1974 | Kun | 165/151 X |
| 3,866,675 | 2/1975 | Bardon et al. | 29/157.4 X |

FOREIGN PATENTS OR APPLICATIONS

| | | | |
|---|---|---|---|
| 840,451 | 7/1960 | United Kingdom | 165/175 |

*Primary Examiner*—C. J. Husar
*Assistant Examiner*—Sheldon Richter
*Attorney, Agent, or Firm*—John C. LeFever

[57] ABSTRACT

A heat exchanger assembly comprising a stacked array of thin-walled heat exchange channel elements, having first fluid entrance and exit faces at opposite ends of the array. The improved headering arrangement includes a resilient gasket disposed around the perimeter of each face against the wall portion ends thereof and header tank means enclosing each face of the array, arranged to bear compressively against the resilient gasket and form a fluid-tight seal between the header tank and the stacked array.

28 Claims, 15 Drawing Figures

HEAT EXCHANGER HEADERING ARRANGEMENT

BACKGROUND OF THE INVENTION

This invention relates to an improved headering means for a heat exchanger comprising a stacked array of thin-walled heat exchange channel elements.

In the field of heat exchange applications requiring pressure-bearing walls as the primary heat exchanger surface, considerable effort has been expended to develop light weight, inexpensive heat exchange elements. In recent years a number of compact heat exchanger designs have been developed which utilize comparatively thin-walled heat transfer channel elements, e.g., 8–12 mils in thickness, of light weight materials such as aluminum. Such types of heat exchangers have particular utility in automobile radiator and heater applications, where size and weight are primary considerations.

An illustrative heat exchanger construction for the foregoing applications is disclosed in U.S. Pat. No. 3,757,856 issued Sept. 11, 1973 to L. C. Kun, wherein each channel element of the heat exchanger is provided with an isostress contoured heat exchange surface comprising a multiplicity of uniformly disposed outwardly extending projections formed from a portion of each wall surface. These projections have load-bearing segments at their extremities whereby the facing walls of adjacent channel elements are mated in supportive relative with each other. Upon being subjected to a differential pressure across the channel wall, a substantially uniform fiber stress distribution is obtained in the isostress contoured surface. This uniform stress distribution substantially eliminates stress concentration points in the walls of the channel elements thereby permitting the walls to be fabricated from very thin sheets of thermally conductive material.

In such heat exchangers constructed from thin-walled channel elements, wherein the channel elements are stacked in an array to form the heat exchanger core, the provision of low-cost, easily fabricated header means which maintain an efficient fluid-tight seal with the channel elements in the stacked array encompasses specific problems not encountered in headering arrangements in heavier walled systems. With channel elements having pressure withholding walls of lower thickness, there is a lower resistance to heat transfer associated with the walls, in other words, a higher rate of heat transfer per unit weight of wall material, which permits the thin-walled channel elements to be closely spaced together to form a highly compact stacked array. Associated with this degree of compactness are correspondingly small dimensions for the channel elements.

As an example of the above-described structural characteristics of thin-walled channel element heat exchangers, in a heat exchanger constructed with channel elements of the type as disclosed in the aforementioned Kun U.S. Pat. No. 3,757,856 and suitable for use as an automobile radiator, the stacked array may be formed of 150 channel elements each 30 inches long with a cross-section characterized by a 1 inch major axis, a minor axis of 0.12 inch and a wall thickness of 0.008 inch. In such array, the spacing between facing walls of adjacent channel elements may be on the order of 0.120 inch. Thus, the provision of inlet header means joined in flow communication with the channel elements at one end of the array and outlet header means joined in flow communication with the channel elements at the opposite end of the array requires the fluid-tight sealing of numerous header-array joints of exceedingly small dimensions. In addition, the thinness of the channel element walls render them easily susceptible to bending and deformation in the heat exchanger fabrication process.

As a consequence of the foregoing characteristics of thin wall channel element heat exchangers, it is both difficult and expensive to employ conventional headering arrangements such as are used in the fabrication of large-scale heat exchangers. For example, in the construction of commercial tube-and-shell heat exchangers and autombile radiators, it is common practice to employ a tube sheet headering arrangement. In such systems, the tubes in the heat exchanger core assembly are characteristically forced through correspondingly sized openings in a sheet member and the latter is then joined to suitable tank or shell means to form a header chamber communicating with the tubes of the core assembly for introduction or withdrawal of fluid being passed through the tube members. Alternatively, the tube members may be smaller in size than the openings in the tube sheet and after being passed through the openings the tubes are expanded as by swaging or other means to form a fluid-tight seal between the tubes and surrounding sheet. These approaches are not practical in application to thin wall channel element heat exchangers, due to their aforementioned susceptibility to bending and deformation during the associated fabrication steps and the need for extremely narrow dimensional tolerances for both the channel elements and the closely spaced tube sheet openings.

As a result of the inapplicability of conventional large-scale heat exchanger headering designs, a variety of header configurations have been proposed to accommodate the specific structural features of thin wall channel element systems. In the aforementioned Kun U.S. Pat. No. 3,757,856, a tank header arrangement is disclosed wherein comb-shaped members are inserted into the end sections of the channel element stacked array from opposite sides such that the corresponding teeth of the respective combs sealingly overlap one another and serve as spacers between adjacent channel elements. A tank is then suitably attached to the periphery of the comb members at each end of the array to form the respective fluid introduction and exit means. This design, while overcoming the inherent deficiencies of the conventional tube sheet headering arrangement, is nonetheless associated with numerous closely spaced comb member-channel element joints which must be leak-tightly sealed so that in the operational mode a fluid fed through the channel elements will not leak into the space between adjacent elements. Accordingly, each of these individual joints must be bonded, as by adhesive, to insure positive sealing, a step which is tedious, time-consuming and costly.

Another type of headering arrangement which has been proposed for thin-walled channel element stacked array heat exchangers incorporates channel elements having closed ends and flat side walls at the end sections with openings in the side walls for ingress and egress of the fluid being flowed through the channel element. In one such arrangement the header means include manifold tubes passing through the openings in the channel elements, the manifold tubes having flow openings whereby fluid communication is established between the tubes and the channel elements. This arrangement requires fluid-tight sealing of the numerous small joints between the tube and the associated flat side wall portions of the stacked channel elements, which is difficult to achieve economically. Another variant configuration under this arrangement involves bonding of the flat side wall portions surrounding the wall openings on adjacent channel elements to each other in wall to wall contacting relationship. This design is somewhat more advantageous in that the joint surfaces have a relatively large area for bonding as compared to the aforedescribed systems so that it is easier to fabricate; nonetheless, a multiplicity of bonding joints, associated with an exceedingly large aggregate joint length, are again employed each of which must be positively sealed to insure operability of the heat exchanger assembly.

Accordingly, it is an object of the present invention to provide an improved headering arrangement for heat exchangers of the type employing a stacked array of thin-walled heat exchange channel elements.

It is a further object of the invention to provide a heat exchanger assembly of the above type which is easily fabricated and incorporates joints having a relatively low aggregate joint length which must be leak-tightly sealed.

Other objects and advantages of the invention will be apparent from the ensuing disclosure and appended claims.

SUMMARY OF THE INVENTION

This invention relates to an improved headering arrangement for a heat exchanger comprising a stacked array of thin-walled channel elements.

Briefly, the invention includes a heat exchanger assembly comprising a stacked array of heat exchanger channel elements, wherein each channel element is bounded by thermally conductive pressure withholding walls of between 0.003 and 1.150 inch thickness, with a first fluid entrance opening at one end, a first fluid exit opening at the opposite end, and end sections having a cross section bounded by flat side wall portions and edge wall portions. Adjacent channel elements in the array are stacked with their flat side wall portions in wall to wall contacting relationship and their edge wall portions in alignment to form a first fluid entrance face at one end of the array and a first fluid exit face at the opposite end of the array. Each of the faces thus has a perimeter defined by edge wall portion ends of the stacked channel elements and side wall portion ends of the outermost channel elements in the array. The pressure withholding walls of adjacent channel elements in the interior of the array are disposed in spaced relationship with respect to each other for flow of a second fluid through the array in the spaces between the channel elements in heat exchange with the first fluid. Inlet header means are joined in flow communication with the first liquid entrance face for introduction of the first fluid to the channel elements, and outlet header means are joined in flow communication with the first fluid exit face for withdrawal of the first fluid from the channel elements.

In accordance with the invention, each of the aforementioned header means comprises the improvement of a resilient gasket disposed around the perimeter of the corresponding face against the wall portion ends thereof. Header tank means enclose the face, having a wall surface portion abuttingly disposed against the resilient gasket and a structurally integral flange member extending outwardly from the stacked array. Means are provided joining the flange member and another structurally rigid part of the heat exchanger assembly to cause the wall surface portion of the header tank means to bear compressively against the resilient gasket for fluid-tight sealing between the header tank and the stacked array.

As used above, the term "resilient gasket" includes any suitable resilient or elastomeric material member which, when disposed around the perimeter of a face of the heat exchanger assembly against the wall portion ends thereof with the wall surface portion of the header tank means bearing compressively against it, is capable of providing a sealed joint which is substantially impermeable to the fluid constituents both internal and external of the joint. Thus, when the aforedescribed heat exchanger assembly is employed for example as a radiator for cooling of an internal combustion engine with air as the exterior heat exchange fluid and a glycol-based aqueous solution, under pressure to prevent fluid loss and overheating, as the interior heat exchange fluid, the resilient gasket must function to maintain the interior pressure at the desired level while preventing any significant leakage of air, glycol or water through the joint between the header tank and the stacked array.

In the broad practice of the invention, suitable materials for the resilient gasket may for example include materials such as Buna-N, silicone and ethylene propylene diene monomer (EPDM) elastomers and adhesive materials such as neoprene and silicone compositions. Further, the specific resilient gasket may be of a type which can be preformed, e.g., provided as a unitary gasket member of the appropriate shape and size, prior to its incorporation into the heat exchanger assembly, or, alternatively, it may be of a type which is formed in situ during the fabrication of the heat exchanger assembly. It will be recognized that these foregoing specific resilient gasket compositions and fabricational characteristics are described only as being illustrative and are not to be construed in any limiting sense as regarding the resilient gaskets which may be effectively utilized in the broad practice of the present invention.

In accordance with the present invention, means are provided for joining the flange member of the header tank means and another structurally rigid part of the heat exchanger assembly to cause the wall surface portion of the header tank means to bear compressively against the resilient gasket for fluid-tight sealing. As used herein, the term "structurally rigid" refers to those parts of the heat exchanger assembly which, when interconnected with the flange member of the header tank means via the joining means, posses sufficient structural integrity to maintain the requisite compression for fluid-tight sealing between the header tank and the stacked array. In practice, this means that the part of the heat exchanger assembly which is associated with the joining means must be designed with sufficient moment of inertia to effectively absorb those loads, including bending and shear loads, incurred in the exertion of compression on the sealant means, without deforming or otherwise reacting in a manner which would cause loss of the fluid-tight seal. Preferably, the required rigidity of such associated part of the heat exchanger assembly is achieved with a low weight of material, so that a comparatively high moment of inertia is required.

Under the foregoing considerations, the structurally rigid part of the heat exchanger assembly which is interconnected with the flange member of the header tank means may, in one embodiment of the invention, suitably comprise a portion of the associated end section of the stacked array. In one especially preferred configuration of this type, as described more fully hereinafter, the flange member of the header tank means is interconnected with a fin structure of the stacked channel element array.

In another embodiment connecting means disposed externally of the channel element stacked array interconnected corresponding portions of the structurally integral flange members, so that the aforementioned another structurally rigid part of the heat exchanger assembly for each header means comprises the structurally integral flange member of the other such heading means. This embodiment has particularly utility in heat exchanger assemblies wherein the first fluid to be flowed through the channel elements is at high pressure, e.g., 60 psig, so that heavier channel element walls, as for example on the order of 0.130 to 0.150 inch thickness, are required. In such assemblies, the degree of compression required to maintain a fluid-tight seal against the high internal pressures is efficiently accommodated by mechanical connecting means joining the respective header flange members.

This invention is based on the discovery that resilient gaskets may advantageously be utilized to provide an effective fluid-tight joint when disposed against the end of a heat exchange channel element wall of exceedingly low thickness which forms a constituent segment of an extended perimeter around a fluid inlet or outlet face in a closely packed stacked array of channel elements.

This discovery is particularly significant in relation to the prior art use of structural components such as elastomeric or resilient materials in the form of gasket members as sealant means. In the past practice of using gaskets to form fluid-tight joints, the gasket is characteristically positioned between joint surfaces of comparatively large area which are then bolted or otherwise connected together so tht the gasket functions as a sealant over these extension surface areas. This practice is based on the fact that numerous materials employed in the fabrication of gaskets are prone to suffer plastic deformation (commonly referred to as "cold" flow) when subjected to a constant compressive stress. Such deformation causes a relaxation of the bolt load, thereby rendering the assembly more susceptible to leakage of fluid through the gasket joint. Accordingly, it is conventional design procedure to fix a comparatively large lower limit for the area of a gasket bearing surface in order to minimize the unit stress imposed on the gasket member, thereby minimizing the occurrence of the "cold" flow phenomenon and assuring the maintenance of a leak-tight system.

As discussed above, conventional use of gasket sealing members is directed to the employment of relatively large joint member surface areas. In unexpected contrast to such conventional practice, the present invention employs the exceedingly small wall end surface areas of the stacked array of heat exchange channel elements as a gasketed surface without adverse loss of sealing capability even after prolonged periods of system operation. As an illustration of the small size of the gasketed surface areas which may be utilized in the practice of the present invention, a heat exchanger constructed in accordance with the invention having 0.008 inch channel element walls and suitable for as an automobile radiator may have a perimetric wall end area for gasket sealing of only 0.5 inch$^2$.

The reasons as to why such small surface regions may be employed as gasketed surfaces without significant loss of joint integrity due to the aforedescribed "cold flow" or other gasket member relaxation phenomena is not fully understood, but are believed to be associated with the peculiar structural characteristics of the inlet-exit faces of the stacked array constructed in accordance with the invention. These faces feature a continuous extended perimeter formed of wall end segments of the stacked channel elements which is capable of exerting a high bearing pressure per unit area of gasket surface, as described more fully hereinafter. In addition, because the adjacent channel elements in the array are stacked with their flat side wall end section portions in wall to wall contacting relationship, the stacked array end sections each provide a structurally rigid matrix with a face which is buttressed by the numerous transversely extending channel element side walls; such rigid matrix possesses a relatively high mechanical strength and is able, for example, to effectively absorb bending and vibration loads which arise in the use of the heat exchanger assembly. The combination of these features may account for the unexpected highly efficient performance of gasket members as sealant means in the practice of the invention. Nonetheless, we do not which to be bound by any particular theory by way of explanation of such performance behavior and, accordingly, the foregoing should not be construed in any manner as limiting the applicability of the present invention, subject only to the essential elements and features disclosed and claimed herein.

The specific improvement features of the heat exchanger assembly of this invention provide a significant advantage over thin-walled heat exchangers of the prior art which required positive leak-tight sealing of numerous discrete and small sized heat exchanger core-header joints. Inasmuch as the inlet and exit faces of the heat exchanger assembly in the present invention each feature a single, extended perimeter joint surface, the fabrication of the assembly is comparatively simpler and less time-consuming and costly, relative to the thin-wall channel element heat exchanger configurations of the prior art.

DESCRIPTION OF THE PREFERRED EMBODIMENT

Figure 1:
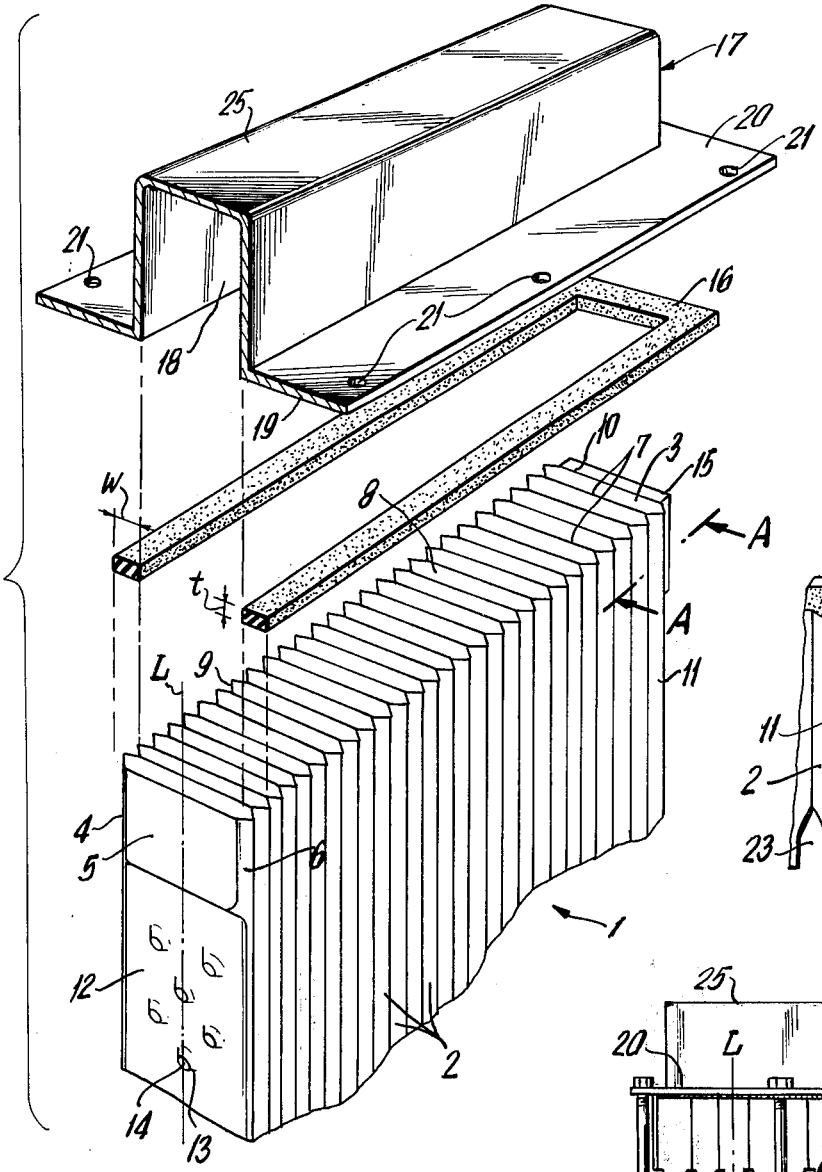
FIG. 1 is an exploded isometric view of a part of a heat exchanger assembly according to one embodiment of the invention featuring a unitary construction header tank means.

Referring now to the drawings, FIG. 1 is an exploded partial view of an illustrative heat exchanger assembly according to the invention featuring a unitary construction header tank means. As shown, the heat exchanger assembly comprises a stacked array 1 of channel elements 2. Each of the channel elements is bounded by pressure withholding walls 12 of 0.008 to 0.012 inch thickness and has open ends 3 for either ingress or egress of the first fluid which is flowed through the channel elements. The channel elements are each formed with end sections 4 having a cross-section bounded by flat side wall portions 5 and end wall portions 6. Adjacent channel elements in the array are stacked as shown with their flat side wall portions in wall to wall contacting relationship, as indicated by reference number 7, and their edge wall portions in alignment to form a face 8 at the end of the array for either entrance or exit of the first fluid which is flowed through the channel elements. This face thus has a perimeter defined by the ends 9 of the edge wall portions of the stacked channel elements and ends 10 of the outermost channel elements 11 in the array.

Each of the aforedescribed channel elements is constructed with a multiplicity of uniformly disposed outwardly extending projections 13 formed from a portion of pressure withholding wall surface in the interior of the array. These projections have load-bearing segments 14 at their extremities whereby the facing walls of adjacent channel elements are mated in supportive relationship with each other. In this manner the pressure force on each channel element wall is transmitted to the facing wall of the adjacent channel element. The channel element surface projections are preferably of a type as disclosed and claimed in the aforementioned U.S. Pat. No. 3,757,856, incorporated herein to the extent pertinent, wherein an isostress wall surface is provided, between and surrounding the load bearing segments which is continuously curved and devoid of local mechanical loading.

The illustrated heat exchanger assembly further comprises structural support member 15. This structural support member has a generally planar surface which is positioned against the end section of the outermost channel wall and suitable attached thereto, as for example by adhesive bonding. The structural support member functions to stiffen the end sections of the outermost channel elements, thereby enhancing the structural integrity of the stacked array.

The headering arrangement in the FIG. 1 system includes a preformed resilient gasket 16 composed for example of silicone rubber. In practice, the resilient gasket should be composed of a material having a Shore A durometer value as measured by ASTM Test No. D-2240, of between 5 and 100 and preferably between 20 and 70. The durometer value is in essence a measure of the hardness of compressibility of a material, and gasket materials having durometer values in the foregoing ranges have been found particularly useful for providing fluid-tightly sealed joints in the manner of this invention. As used hereinafter, all durometer values will be understood to refer to the Shore A Scale. In addition, it is also desirable in practice to provide the resilient gasket with a thickness in the uncompressed state, as measured in the direction extending outwardly from the end of the channel element stacked array and generally parallel to the longitudinal axis L of the Channel elements, of between 1/32 and ½ inch, and a width W in the uncompressed state, as measured transversely to the outwardly extending direction, of at least 3/16 inch. The basis and reasons for such dimensional values will be described more fully hereinafter.

In the stacked array 1, the resilient gasket 16 is suitably disposed around the perimeter of face 8 against the wall portions thereof so as to overlay the edge wall portion ends 9 and side wall portion ends 10 defining the perimeter. Header tank means 17 are provided, comprising a tank enclosure portion 25 having U-shaped cross section defining an open tank channel 18 communicating with and enclosing the stacked array face 9 and a structurally integral flange member 20 extending outwardly from the stacked array. The header tank means as shown represent a unitary construction such as may be stamped or molded as a single sheet of structural material, e.g., aluminum or plastic. It will be recognized that the tank enclosure portion 25 and the flange member 20 may be separately individually fabricated prior to the final assembly of the header tank means, but regardless of mode of fabrication, the flange member is provided as a structurally integral constituent of the header tank means.

In the illustrated arrangement, the inner segment of flange member 20 adjacent the vertically disposed walls of tank enclosure portion 25 constitutes a wall surface portion 19 which is abuttingly disposed against the gasket 16. In the fully assembled structure, suitable connection means (not shown in FIG. 1 for clarity) are provided joining the flange member, by means of the connector openings 21 therein, and another structurally rigid part of the heat exchanger assembly to cause the wall surface portion 19 of the header tank means to bear compressively against the gasket 16 for fluid-tight sealing between the header tank and the stacked array. Under the compression exerted by wall surface portion 19, the resilient gasket sealingly engages the constituent wall portion ends 9 and 10 of the perimeter of face 8 and is held in the compressed state between the wall portion ends and wall surface portion 19 to maintain a sealed joint between the header and array.

In accordance with the present invention, the channel elements in the heat exchanger assembly are bounded by thermally conductive pressure withholding walls of between 0.003 and 0.150 inch. A wall thickness of less than 0.003 inch is generally unsuitable for for channel elements due to the susceptibility of such low thicknesses to local imperfections in the material of construction which may be formed either during fabrication or in use. Wall thicknesses above 0.150 inch are not suited to this invention because the heat transfer efficiency of the channel elements, as based on a unit weight of construction material, decreases with increasing wall thickness. Accordingly, maximize the heat exchange efficiency of the system, the channel element walls are characteristically designed to provide a minimum wall thickness for a given pressure differential across the channel element walls between the first and second (internal and external) fluid species. At walls thicknesses above 0.150 inch, the associated pressure differential across the channel element walls and hence across the header-stacked array joint is so large that the corresponding level of gasket compression required for fluid-tight sealing tends to exceed the level which can be satisfactorily accommodated by the thin-walled channel elements without susceptibility to buckling or deformation. Under the foregoing considerations, channel element wall thickness in the range of 0.003 to 0.020 inch are particularly preferred in practice.

Figure 2:
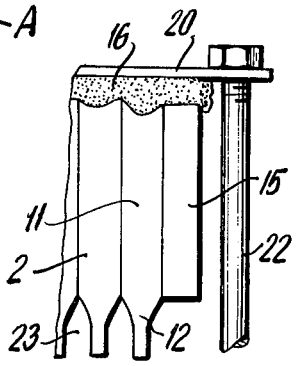
FIG. 2 is an elevational view of the heat exchanger headering arrangement along line A - A of FIG. 1, as fully assembled.

FIG. 2 shows an elevational view of the heat exchanger headering arrangement of FIG. 1 along line A-A, as fully assembled and with suitable connecting means joined to flange member 20. As illustrated, the pressure withholding walls 12 of adjacent channel elements 2 in the interior of the stacked array are disposed in spaced relationships with respect to each other for flow of a second fluid through the array in the spaces 23 between the channel elements in heat exchange with the first fluid flowing through the channel elements. Resilient gasket 16 is compressively positioned between the perimetric channel element wall portion ends and the wall surface portion of the flange member 20. In some instances, it may be desirable to decrease the amount of gasket compression required for fluid-tight sealing by adhesively bonding the gasket to the wall surface portion of the flange member 20 or additionally to the perimetric wall portion ends of the first fluid inlet or outlet face, as discussed hereinafter. The structural support member 15 is disposed against the flat side wall portion at the end section of the outermost channel element 11 in the stacked array. The wall surface portion of the header tank means is made to bear compressively against the resilient gasket by tie bar assembly 22 joining the flange member 20 and another structurally rigid part of the heat exchanger assembly.

Figure 3:
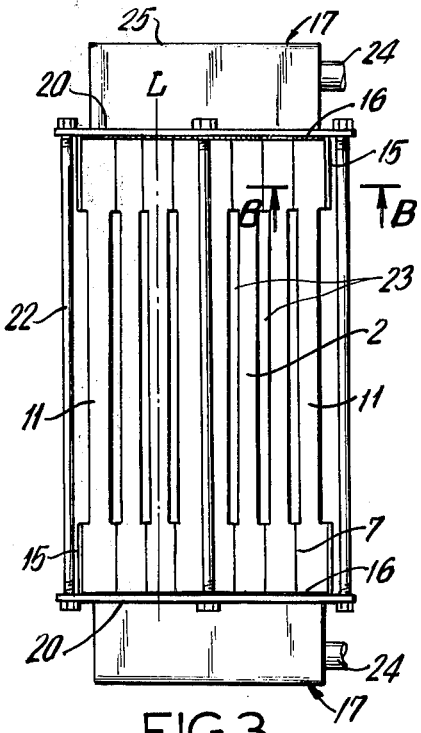
FIG. 3 is an elevational view of a heat exchanger of the type shown in FIG. 1, as fully assembled.

An elevational view of a heat exchanger of the type shown in FIG. 1 is illustrated in FIG. 3, as fully assembled. The assembly of FIG. 3 is constructed and arranged for low of the second (external) fluid through the stacked array in the spaces 23 in a direction normal to the longitudinal axis L of the channel elements 2. The adjacent channel elements in the array are stacked with their end section flat side wall portions bonded in wall to wall contacting relationship, as at 7. Structural support members 15 are disposed against the outermost channel elements 11 in the stacked array. Resilient gaskets 16 are disposed around the perimeters of the respective first fluid inlet and first fluid outlet faces against the wall portion ends thereof. The header tank means 17 for this system are of the type shown in FIG. 1 comprising flange members 20, and provided with respective first fluid inlet and outlet conduits 24. In this system the means joining the flange members 20 of each header tank means another structurally rigid part of the heat exchanger assembly comprise the several tie bar assembly mechanical connecting means 22 disposed externally of the stacked array and interconnecting corresponding portions of the flange member 20 of each of the respective header tank means. Thus, the previously defined structurally rigid part of the heat exchanger assembly for each header means in this arrangement comprises the structurally integral flange member of the other header means.

Figure 4:
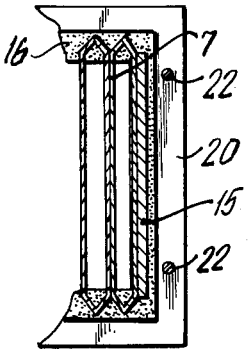
FIG. 4 is a cross-sectional view of the heat exchanger assembly of FIG. 3 along the line B—B.

A cross-sectional view of the FIG. 3 heat exchanger assembly along the line B-B is illustrated in FIG. 4 to show the details of the headering arrangement. Resilient gasket 16 is disposed around the perimeter of the stacked array between the channel element and section wall portion ends and the bearing wall surface portion of the flange member 20. Tiebar assembly mechanical connecting means 22 are joined to the flange member and sidebar support member 15 is positioned against the flat side wall portion of the outermost channel element, which is stacked in wall to wall contacting relationship with the adjacent channel element at 7.

Figure 5:
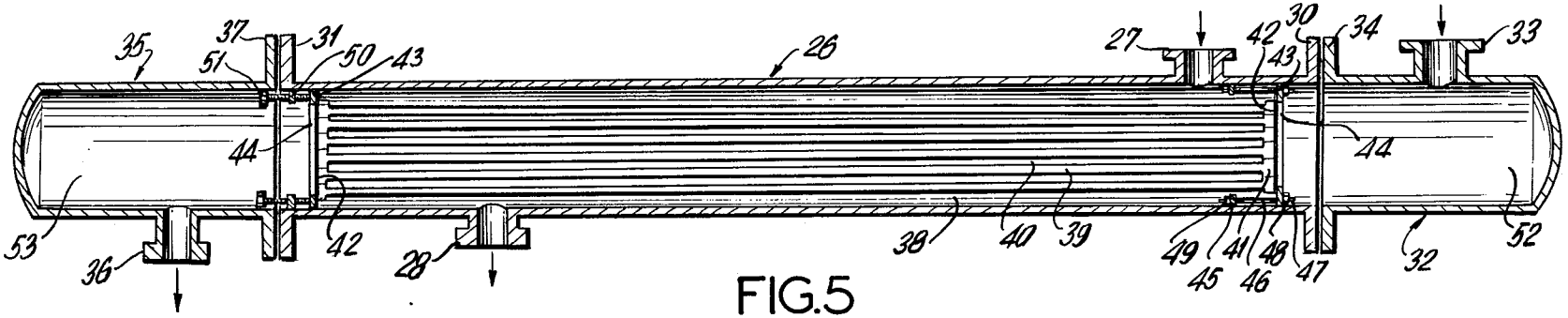
FIG. 5 is a sectional elevational view of a heat exchanger assembly according to another embodiment of the invention, of the shell-and-tube type.

FIG. 5 is a sectional elevational view of a heat exchanger assembly according to another embodiment of the invention, of the shell and tube type. The assembly features a cylindrical shell section 26 with second fluid inlet nozzle 27 and second fluid outlet nozzle 28. The cylindrical shell section is also provided with head flanges 30 and 31 at its respective ends, whereby the shell section is joined to the first fluid inlet head section 32 featuring first fluid inlet head nozzle 33 and head flange 34 at one end and to the first fluid outlet head section 35 featuring first fluid outlet head nozzle 36 and head flange 37 at the other end. As fully assembled, the respective mating head flange pairs 30, 34 and 31, 37 may be joined by bolting or other suitable joining arrangement (not shown).

Multiple stacked arrays 38 of heat exchange channel elements 39 are positioned in the interior of the cylindrical shell section 26. Each of these channel elements is bounded of thermally conductive pressure withholding walls of for example 20 mils thickness, with a first fluid opening at one end and a first fluid exit opening at the opposite end. The channel elements may have a circular cross section over the intermediate sections of their length in the interior of the array, with the walls of adjacent channel elements disposed in spaced relationship with respect to each other to accommodate axial flow of the second fluid through the array in the spaces 40 between the channel elements, in heat exchange with the cocurrently flowing first fluid.

The end section 41 of the channel elements in the respective arrays have a cross-section bounded by flat side wall portions and edge wall portions. Adjacent channel elements in the arrays are stacked with their flat side wall portions in wall to wall contacting relationship and their edge wall portions in alignment to form a first fluid entrance face at one end of the array and a first fluid exit face at the opposite end of the array. Each such face thus has a perimeter defined by edge wall portion ends of the stacked channel elements and the side wall portion ends of the outermost channel elements in the array, as in the aforedescribed systems of FIGS. 1–4.

The header means in the FIG. 5 system include resilient gaskets 42 disposed around the perimeter of each face against the wall portion ends thereof, at the ends of the respective arrays. The header tank means include circular plate wall members 43 vertically disposed at opposite ends of the array and having openings 44 to permit fluid flow communication between the channel elements of the stacked arrays and the inlet header plenum space 52 and the outlet header plenum space 53. In this arrangement the outer circumferential peripheral portions of the circular plate wall members 43 thus constitute the structurally integral flange members extending outwardly from the stacked array.

Two variant headering subassembly portions are employed in the FIG. 5 system. At the first fluid inlet section of the heat exchanger, the means joining the flange members and another structurally rigid part of the heat exchanger assembly comprise threaded tie bolts 46 having one end extending through suitable openings in extension plates 45 welded to the shell wall and secured by locking nuts 49. The other ends 47 of the tie bolts pass through openings in plate wall member 43 and are secured by tightening nuts 48. By tightening of the nuts 48, wall surface portions of plate wall member 43 are caused to bear compressively against the resilient gasket for fluid-tight sealing between the header tank closing plenum space 52 and the stacked array. At the first liquid outlet section of the heat exchanger, a similar construction is employed, except that the threaded tie bolts 51 are threaded through the extension plates 50 and by tightening of the tie bolts, wall surface portions of the plate wall member 43 are caused to bear compressively against the resilient gasket 42.

Figure 6:
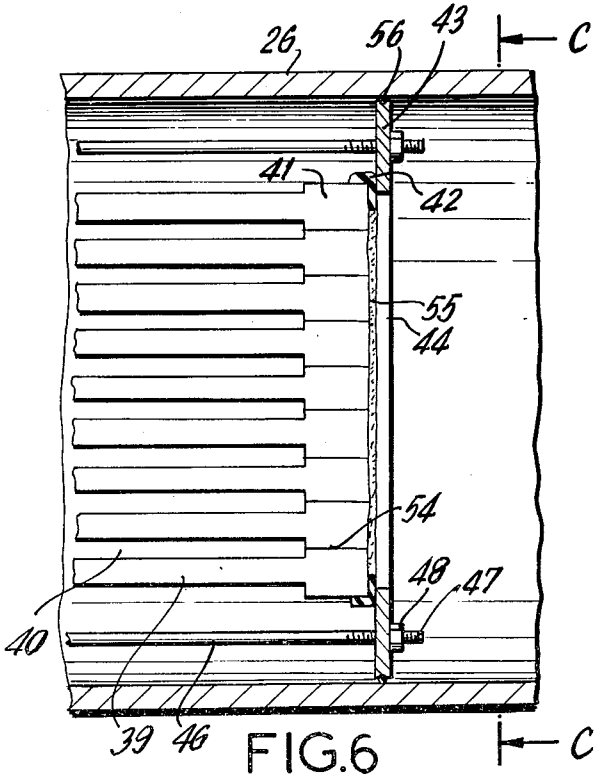
FIG. 6 is an enlarged partial sectional view of the FIG. 5 heat exchanger assembly, showing the details of the headering arrangement.

FIG. 6 is an enlarged partial sectional view of the first liquid inlet section of the FIG. 5 heat exchanger assembly, showing the details of the headering arrangement more clearly. As shown, resilient gasket 42 is disposed around the perimeter of the inlet face of the stacked array, as formed in part by the edge wall portion ends 55 of the channel elements. The edges of circular plate wall members 43 may be leak-tightly sealed against the adjacent inner surface of cylindrical shell 26 by an O-ring sealing member 56 disposed in a groove at the edge of the plate wall member. The headering arrangement of FIGS. 5–6 is particularly flexible in operation, inasmuch as the degree of gasket compression required for liquid-tight sealing can be easily varied by loosening or tightening of the nuts 48 at the ends 47 of tie bolts 46, to effectively accommodate changes in operating pressure conditions.

Figure 7:
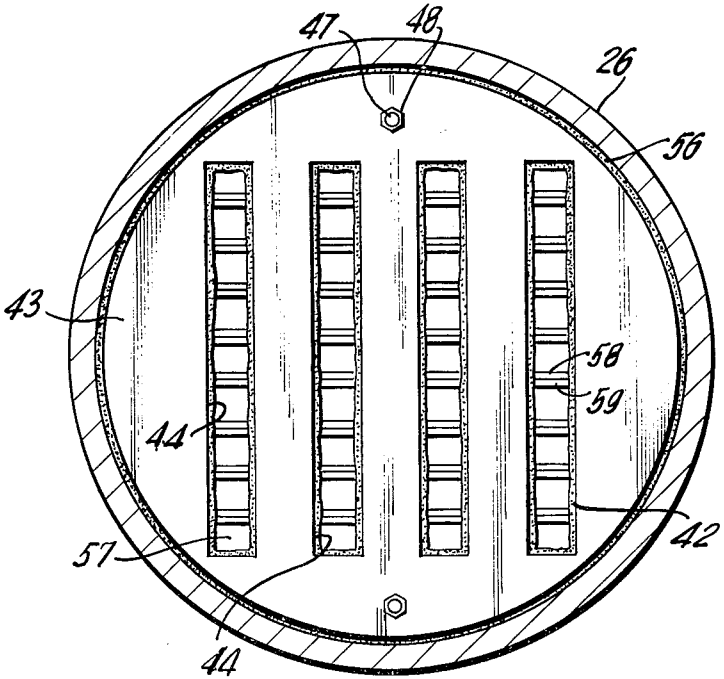
FIG. 7 is cross-sectional view of the FIG. 6 headering arrangement along the line C—C.

FIG. 7 is a cross-sectional view of the FIG. 6 headering arrangement along the line C-C. As shown, four stacked arrays are disposed in the interior of cylindrical shell section 26. The channel elements in the arrays are stacked with their flat side wall portions, e.g. 58 and 59, in wall to wall contacting relationship, with the individual channel elements defining longitudinally extending first liquid flow passages 57. The openings 44 in plate wall members 43 provide fluid flow communication between the channel elements of the stacked arrays and the inlet header plenum space, and gaskets 42 serve to seal the header-stacked array joints.

Figure 8:
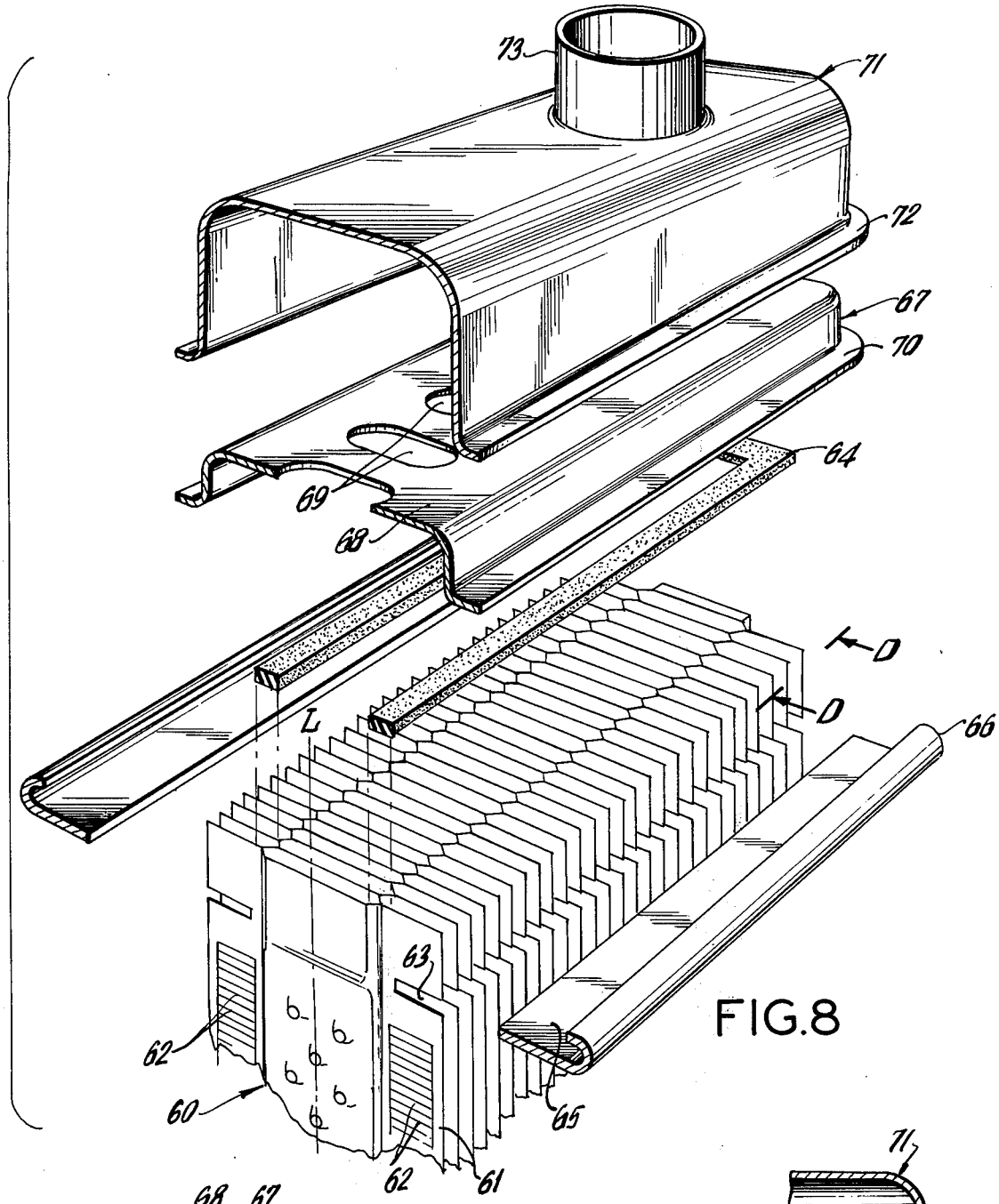
FIG. 8 is an exploded isometric view of a heat exchanger assembly according to still another embodiment of the invention in which the flange member of the header tank means is interconnected with the fin structure of the stacked channel element array.

FIG. 8 is an exploded isometric view of a heat exchanger assembly according to another embodiment of the invention in which the flange member of the header tank means is interconnected with the fin structure of the stacked array of channel elements. In this embodiment, the stacked array 60 and preformed resilient gasket 64 and constructed and formed in a manner identical to that described in connection with the embodiment of FIG. 1, except tht secondary surface heat transfer fins 61 are joined to the edge wall portions of the channel elements and extend generally outwardly therefrom. These secondary surface fins may suitably feature slatted louvered deformations 62 on the fin surface for added enhancement of the heat transfer.

Figure 9:
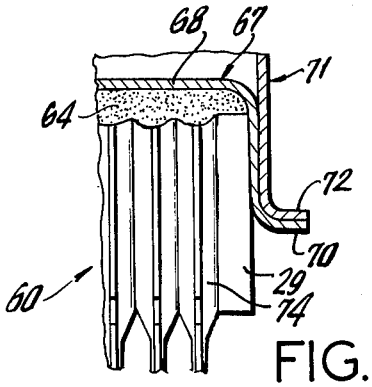
FIG. 9 is a sectional elevational view of a part of the heat exchanger headering arrangement along line D—D of FIG. 8, as fully assembled.
Figure 10:
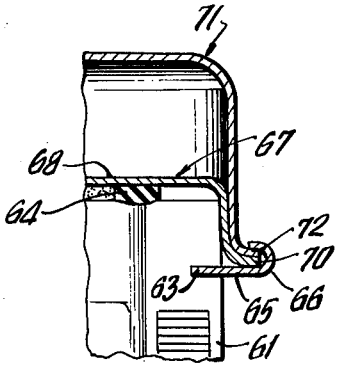
FIG. 10 is another sectional elevational view of a part of the heat exchanger headering arrangement of FIG. 8, as fully assembled.

In this assembly, the secondary surface heat transfer fins are each provided with a notch 63 in the fin surface extending from the outermost fin edge inwardly toward the channel element joined thereto. The notches of the respective fins are transversely aligned with respect to the longitudinal axis L of the channel elements, preferably in a plane substantially normal to the longitudinal axis. The header tank means for this system comprise an inner tank member 67, featuring structurally integral flange member segment 70 and having a plurality of spaced openings 69 therein which are disposed in fluid flow communication with the open ends of the channel elements in the stacked array 60 to provide for uniform distribution of the first fluid. The portion of the inner tank member adjacent to and surrounding the series of openings 69 comprises the wall surface portion 68 which is abuttingly disposed against the resilient gasket. The header tank means further comprise an outer tank member 71 having a first liquid inlet or outlet conduit 73 joined thereto and featuring structurally integral flange member segment 72. In this arrangement, the outer tank member 71 is superpositioned over inner tank member 67 as shown in FIGS. 9 and 10 to form the composite structurally integral flange member comprised of flange member segments 70 and 72. The overlapping sections of the vertically disposed walls of the tank members thus extend downwardly, in the orientation shown in the drawings, over the associated end section of the stacked array. As shown in FIG. 9, which is a sectional elevational view along line D-D of FIG. 8, the lower section of the vertically disposed wall of the inner tank member 67 is fitted over and positioned against the structural support member 29, which in turn is positioned against the flat side wall portion of the outermost channel element 74 in the stacked array 60. As shown in FIG. 10, which is another sectional view of a part of the assembled heat exchanger headering arrangement of FIG. 8, the lower section of the vertically disposed wall of the inner tank member 67 also includes a portion which is fitted over and positioned against the outermost edges of the fins 61 at the associated end section of the stacked array.

In the assembly of FIGS. 8-10, the means joining the flange member, comprises of segments 70 and 72, and another structurally rigid part of the heat exchanger assembly comprise the transversely extend plate member 65. This plate member is positioned so that it extends inwardly into the notches 63 of the fins 61 and also extends outwardly beyond the outermost edges of the fins. The plate member is interconnected with the composite flange member by means of an outer end segment 66 suitably crimped around an outer end segment of the flange member 70, 72 to cause the wall surface portion 68 of the header tank means to bear compressively against the resilient gasket 64 for fluid-tight sealing between the header tank and the stacked array. Alternatively, the plate member 65 may be suitably bolted or similarly interconnected with the flange member 70, 72 to exert the requisite compression on gasket 64; in such case, the plate member crimped outer end segment 66 would not be required. In the FIGS. 8-10 embodiment of the invention, the another structurally rigid part of the heat exchanger assembly for the headering arrangement comprises the associated end section of the stacked array.

Figure 11:
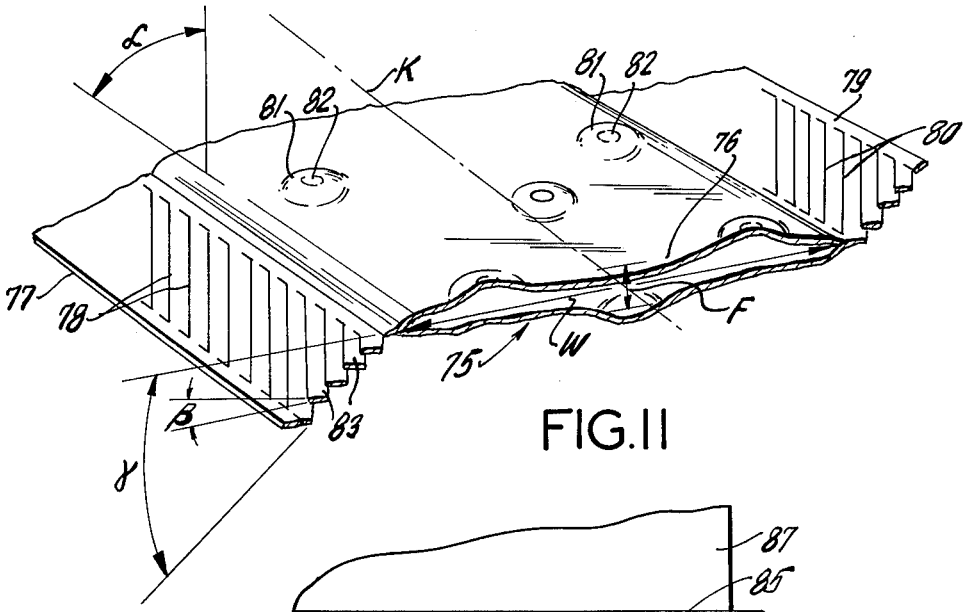
FIG. 11 is an isometric view of a single heat exchange channel element such as may advantageously be used in the practice of the invention.

FIG. 11 is an isometric view of a single heat exchange channel element such as may advantageously be used in the practice of the invention. The channel element 75 is provided with secondary surface heat transfer fins 77 and 79 which are joined to the respective edge wall portions of the channel element and extend generally outward therefrom. The fins are each provided with louver type fin surface distortions, preferably of the type disclosed and claimed in U.S. Pat. No. 3,845,814, issued Nov. 5, 1974 in the name of L. C. Kun. The channel element features isostress contoured wall surfaces 76 with uniformly disposed outwardly extending wall projections 81, having load-bearing segments 82 at their extremities. Geometric characteristics of the channel element include a longitudinal length line K, with the cross-section of the channel element perpendicular to the longitudinal length line having a major axis maximum width line W and a minor axis F. The minor axis dimension F is not a structurally measurable value, but is rather determined by dividing the measured volume of the channel element by the quantity (K x W), where the values of K and W are directly measured. In accordance with the teachings of the aforementioned U.S. Pat. No. 3,845,814, the widths of the respective secondary surface fins 77 and 79 are between 0.1 and 0.6 inch and each fin has a multiplicity of slotted apertures arranged in a lower configuration. The adjacent slats 83 are separated by slot-shaped apertures having the fin angle $\gamma$ between 0° and 60° where $\gamma$ is the angle formed between the plane of the fin and a plane containing the maximum dimension width line W and the channel's longitudinal length line K. The width of the slats 83 is between 0.82 inch and 0.10 inch and the slat angle $\beta$ is between 15° and 90° where $\beta$ is the angle formed between the plane of the fin and the plane of the slats. Lastly, the slot angle $\alpha$ formed between the longitudinal length line K of the channel and the longitudinal length line of the slots, is between 0° and 180°. Such geometry of secondary surface heat exchange fins is particularly preferred in applications where heat exchanger assemblies according to the present invention are employed as automobile heaters and radiators.

Figure 12:
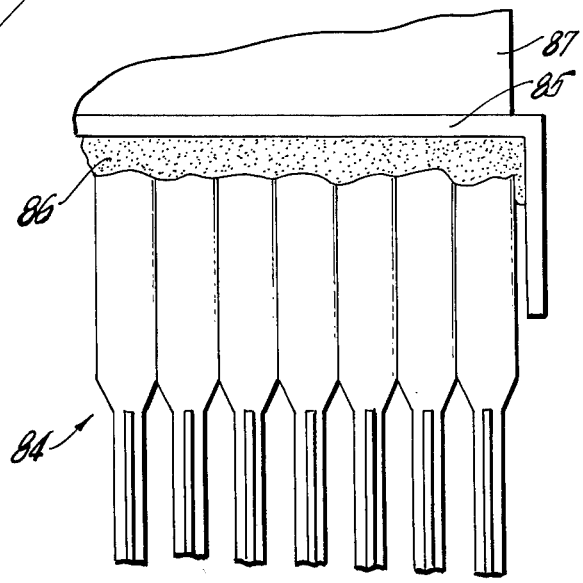
FIG. 12 an elevational view of a part of a heat exchanger assembly according to yet another embodiment of the invention featuring a formed-in-place resilient gasket.

FIG. 12 is an elevational view of a part of a heat exchanger assembly according to yet another embodiment of the invention featuring a formed-in-place resilient gasket. The gasket may suitably be fashioned in situ from either a single or a two-component adhesive composition, as for example RTV-732 silicone adhesive (single component) or XCF-3-7024 silicon adhesive (two component), products of Dow Corning Corportion, Midland, Michigan. In the fabrication of the assembly comprising stacked array 84, a bead of the adhesive composition is applied to the channel element wall portion ends defining the perimeter of the first fluid entrance or exit face. The header tank means 87 and stacked array 84 are then brought together and contacted such that the bead of adhesive forms a coherent adhesive mass 86 joining the header tank means and the stacked array, which is cured in situ to provide the resilient gasket for the system. After the adhesive is fully cured, the appropriate joining means (not shown) may be connected to flange member 85 and to another structurally rigid part of the heat exchanger assembly to cause the wall surface portion of the header tank means to bear compressively against gasket 85 for fluid-tight sealing between the header tank and the stacked array.

Figure 13:
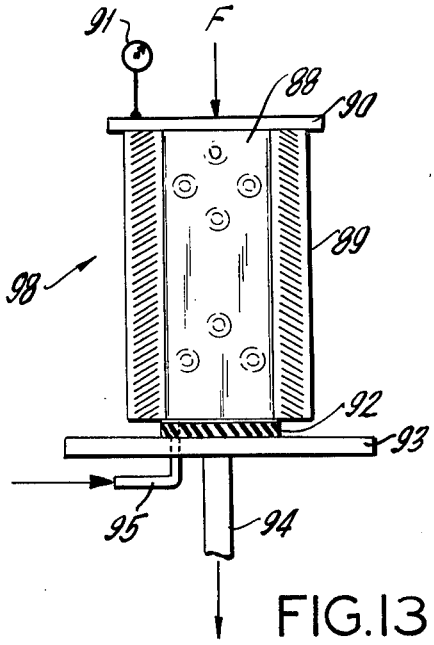
FIG. 13 is an elevational view of an apparatus used to test various resilient gaskets.

FIG. 13 is an elevational view of an apparatus used to test various types of resilient gaskets such as may advantageously be employed in the practice of the present invention. This apparatus was more specifically employed to determine the relationship between internal pressure in a heat exchanger assembly constructed in accordance with the invention and the degree of gasket compression required for fluid-tight sealing therein.

Figure 14:
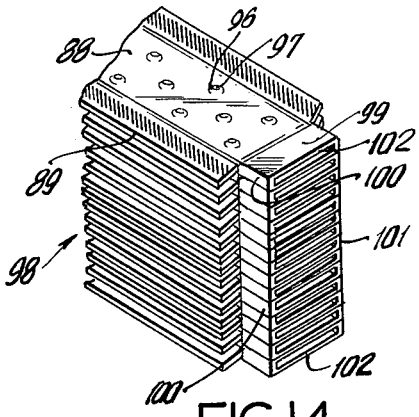
FIG. 14 is an isometric view of a channel element stacked array such as used in the FIG. 13 testing apparatus.

The heat exchanger test section 98 utilized in the FIG. 13 apparatus comprised a stacked array of channel elements 88, each having secondary surface heat transfer fins 89 joined to its edge wall and extending generally outwardly therefrom. The test section stacked array is shown in more detail in the isometric view of FIG. 14 and was formed from 10 channel elements of aluminum construction, each having structural characteristics as generally shown in FIG. 11 with a length measured along the longitudinal length line K of 2.0 inches, with a major axis W of 0.875 inch, a minor axis F of 0.120 inch, and a wall thickness of 0.008 inch. The channel elements featured in isostress surface with a multiplicity of uniformly disposed outwardly extending projections 96 formed from a portion of each wall surface and having load bearing segments 97 at their extremities whereby the facing walls of adjacent channel elements in the interior of the array were mated in supportive relationship with each other. Each channel element had an end section with a cross-section bounded by flat side wall portions 99 and edge wall portions 100. The adjacent channel elements in the array were stacked with their flat side wall portions in wall to wall contacting relationship and adhesively bounded together with an epoxy adhesive and thin edge wall portions in alignment to form an open face at one end of the array. This face at the open end had a perimeter of 4.85 inches as defined by the edge wall portion ends 101 of the stacked channel elements and side wall portion ends 102 of the outermost channel elements in the array; the other end of the stacked array was fluid-tightly sealed closed by adhesive bonding of the array to bearing plate 90.

The test section 98 was assembled in the test apparatus with the perimeter of its open face positioned against test gasket 92, which was in turn positioned on platform 93. Platform 93 was supported on the load cell sensor 94 joined to suitable load cell means (not shown). A fluid flow conduit 95 was provided as shown with an outlet section passing through an opening in platform 93 and terminating in the interior of stacked array test section 98. Dial guage 91 was suitably mounted above bearing plate 90 to measure its vertical travel.

In the actual testing mode, the lower portion of the apparatus assembly, including the gasketed end of stacked array test section, was submerged in water. The stacked array test section was then pressurized with air entering at elevated pressure through fluid flow conduit 95 up to a first pressure $P_1$ which caused bubbles to emit from the gasket joint. A force F was then applied to bearing plate 90 and increased to the value $F_1$ at which sufficient compression was exerted to fluid-tightly seal the gasket joint, i.e., to cause cessation of the bubble emittance. Readings from dial guage 91, as recorded initially and at the point fluid-tight sealing was achieved, permitted calculation of the amount of gasket compression required for fluid-tight sealings. The test was subsequently repeated at various levels of pressure $P_1$ to generate corresponding values for required gasket compression. From these data, the force $F_o$ which must be exerted on the gasket in order to assure fluid-tight sealing at the heat exchanger internal fluid pressure $P_1$ and at atmospheric pressure is readily calculated as $$F_o = F_1 - (P_1 \times A_1)$$

where $F_1$ is the measured load cell reading at the point of fluid-tight sealing and $A_1$ is the area of the platform surface within the perimeter of the stacked array.

The foregoing testing procedure and calculations were performed for various resilient gaskets, as described in Table I below.

TABLE I

CHARACTERISTICS OF VARIOUS EVALUATED RESILIENT GASKETS

Figure 15:
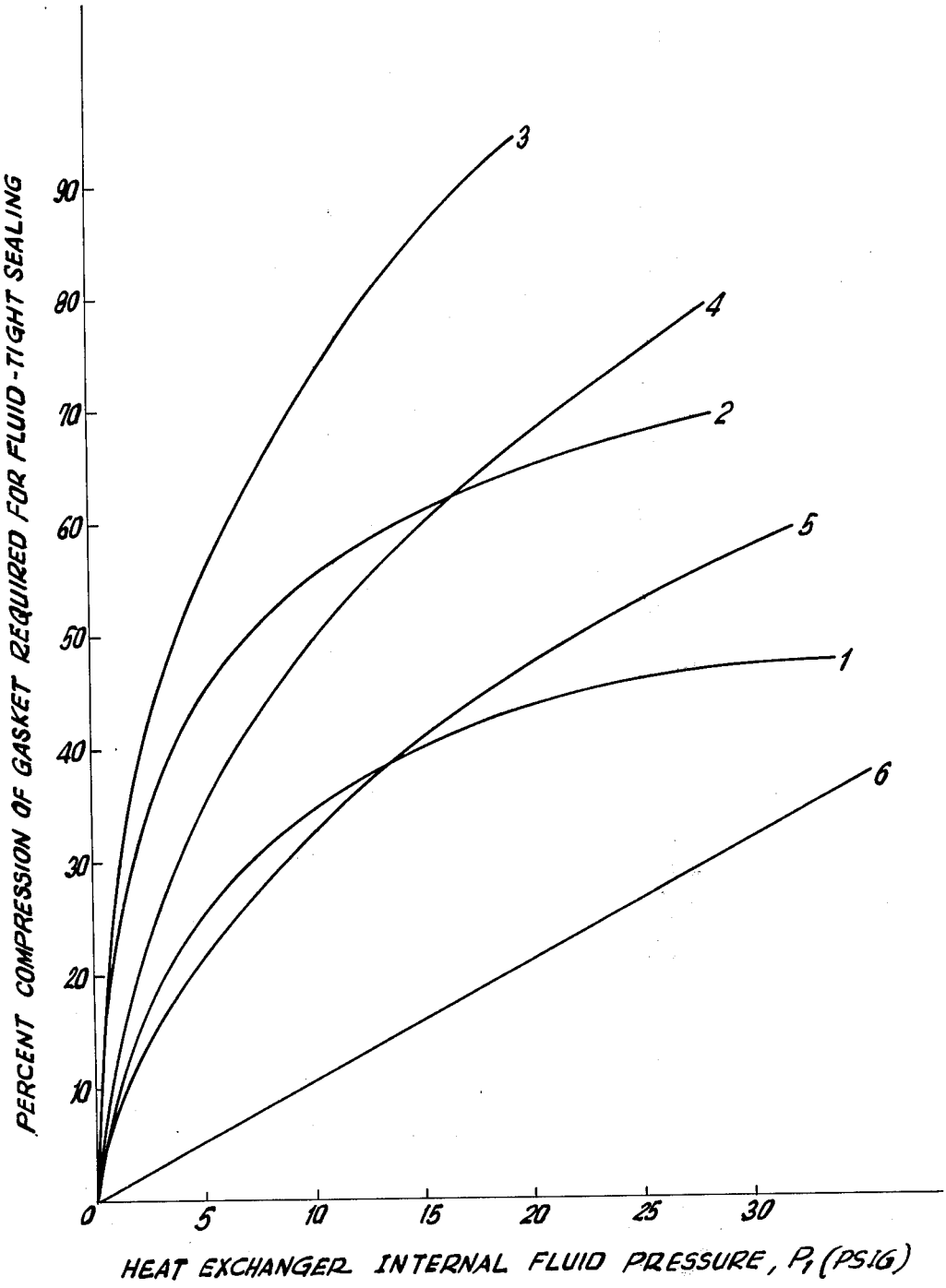
FIG. 15 is a graph of the precent compression of the resilient gasket required for fluid-tight sealing plotted as a function of heat exchanger internal fluid pressure, for a stacked array of the type shown in FIG. 14 with various resilient gaskets.

| FIG. 15 Reference No. | Resilient Gasket Composition | Gasket Structure | Thickness[1] | Durometer Value[2] | Form of Bonding |
|---|---|---|---|---|---|
| 1 | EPDM Elastomer | Preformed Gasket | 0.125" | 60 | Non-Bonded |
| 2 | BUNA-N Elastomer | Preformed Gasket | 0.125" | 40 | Non-Bonded |
| 3 | Silicone Elastomer | Preformed Gasket | 0.125" | 25 | Non-Bonded |
| 4 | Silicone Elastomer | Preformed Gasket | 0.125" | 25 | Single-Bonded |
| 5 | Silicone Elastomer | Preformed Gasket | 0.125" | 25 | Double-Bonded |
| 6 | Silicone Adhesive | Formed-in-Place Gasket | 0.122" | 34 | Self-Bonded |

[1]As measured in the uncompressed state.
[2]As measured by ASTM Test No. 2240.

As used in Table I, the term "performed gasket" refers to a gasket of the type as shown and described in connection with FIGS. 1 and 8 herein, provided as a unitary member of the appropriate shape and size. The term "formed-in-place gasket" refers to a gasket of the type as shown and described in connection with FIG. 12 herein which is formed in situ during fabrication of the heat exchaner assembly. The term "non-bonded" indicates that the gasket was not bonded to either the channel element wall portion ends of the stacked array or to platform 93. "Single-bonded" denotes the systems wherein the gasket was adhesively bonded to platform 93 with a one-component silicon rubber adhesive; "double-bonded" refers to systems wherein the resilient gasket was adhesively bonded to both the channel element wall portion ends of the stacked array and to platform 93. "Self-bonding" characterizes the formed-in-place gasket, which develops adhesion to the channel element wall portion ends of the stacked array and to the platform 93 during its formation.

The results of the foregoing tests are shown in the graphs of FIG. 15, with the curves for the respective gaskets being identified by the reference numbers listed in Table I. FIG. 15 is a graph of the percent compression of the gasket required for fluid-tight sealing, plotted as a function of the heat exchanger internal fluid pressure $P_1$, in units of psig. As shown by FIG. 15, gaskets fabricated of easily compressible, low durometer material required a high level of compression for fluid-tight sealing as compared to higher durometer materials. For example, at a heat exchanger internal fluid pressure $P_1$ of 15 psig, the 25 durometer silicone elastomer gasket required 85% compression for fluid-tight sealing, whereas the 40 durometer nitrile (Buna-N) elastomer gasket required 61% compression and the 60 durometer ethylene propylene diene monomer (EPDM) elastomer required only 40% compression. The FIG. 15 graph also shows that adhesive bonding of the gasket significantly reduces the amount of compression required for fluid-tight sealing. As compared to the 85% compression at internal pressure $P_1$ of 15 psig for the non-bonded silicon elastomer gasket of curve 3, the single-bonded silicone elastomer of curve 4 required 59.5% compression, the double-bonded silicone elastomer of curve 5 required 41% compression and the formed-in-place silicone adhesive gasket of curve 6 required 16% compression, at the same internal pressure $P_1$ of 15 psig. The latter compression value, for the self-bonded formed-in-place gasket of curve 6, is particularly illustrative of the advantages of extensive bonding, inasmuch as the gasket of curve 6 requires only about 19% of the compression level which is required for fluid-tight sealing with the non-bonded gasket of curve 3 at 15 psig internal pressure. As shown in FIG. 15, the requisite sealing compression of the resilient gasket approaches 0% at $P_1$ values close to 0. Nonetheless, it has been found advantageous in practice to employ some degree of gasket compression in the manner of this invention even in heat exchanger systems having essentially atmospheric (0 psig) internal fluid pressure, in order to avoid fluid leakage through the gasket due to surface asperities in the gasket or joint members and in order to provide dimensional tolerances for the header-stacked array joint construction which are practical for large-scale commercial manufacture of the heat exchanger assembly.

During the foregoing tests, it was unexpectedly found that the primary source of bubble emittance, during the period in which the applied force on the bearing plate 90 was increased to the value $F_1$ required for fluid-tight sealing, was the region between the gasket 92 and the platform 93. The narrow perimetric gasket bearing surface defined by the wall portion ends of the thin-walled stacked channel elements, having an exceeding low surface area, of a magnitude which prior art designs using gaskets to form fluid-tight joints have purposely avoided, has been discovered to be a more effective surface for fluid-tight sealing than an extended area surface, such as provided between the gasket and the platform of the test apparatus. The excellent gasket sealing behavior afforded by the channel element wall portion ends has been determined to reflect a high pressure per unit area of gasket surface exerted by the channel element wall portion ends.

It has been found that in heat exchanger assemblies constructed in accordance with the present invention, having wall thicknesses on the order of 150 mils and resilient gasket widths greater than ⅜ inch, that the bearing pressure developed on the stacked array side of the gasket is characteristically more than twice the bearing pressure developed on the header tank side of the gasket at the gasket compression levels necessary for fluid-tight sealing, and that with' wall thicknesses of less than 20 mils and gasket widths greater than 3/16 inch, the bearing pressure developed on the stacked array side of the gasket is typically an order of magnitude greater than the bearing pressure developed on the header tank side of the gasket. Such relative pressure levels provide for highly efficient fluid-tight sealing between the header tank and the stacked array, with the higher bearing pressures between the stacked array and the gasket surface enabling the gasket to be strongly held in place by the stacked array so that it possesses a high degree of structural stability.

In this regard, it is not desirable to employ gaskets having widths of less than 3/16 inch in the practice of the invention, due to their susceptibility to deformation and displacement by lateral forces, which can cause the gasket to roll between the respective bearing surfaces. As also based on considerations of structural stability, gaskets of the aforedescribed preformed type should have a thickness of between 1/32 and ½ inch and preferably between 1/16 and 3/16 inch. In heat exchange assemblies constructed according to the invention and employing gaskets of the above-described formed-in-place type, the gasket thickness should not exceed ¼ inch and preferably ⅛ inch in order to insure the formation of a void-free and homogeneous composition of the formed gasket.

With respect to gasket material characteristics, FIG. 15 has been discussed earlier herein as illustrating the significant variation in the gasket compression required for fluid-tight sealing with respect to change in the hardness or compressibility characteristics of the gasket material, as measured by the durometer value. In practice, it is desirable to employ a gasket material of less thatn 100 in order to avoid excessive compression force requirements such as are unsuitable for the thin-walled channel element stacked array. Similarly, it is desirable to avoid the use of gasket materials of less than 5 durometer due to their inherent susceptibility to shear and/or creep under compression. Accordingly, gasket materials of between 5 and 100 durometer are preferred in practice.

As an illustrative example of the invention, a heat exchanger of the type shown in FIG. 8 with channel elements of the configuration shown in FIG. 11 was constructed for use as an automobile radiator and employed with a glycol-based aqueous solution as the internal first fluid medium and air as external second fluid medium. The radiator assembly was 25.0 inches wide and 18.25 inches high and comprised a stacked array of 177 channel elements, each having a major axis of 0.860 inch and a minor axis of 0.120 inch. The stacked array was constructed with a spacing between adjacent channel elements in the interior of the array of approximately 0.155 inch. The resilient gaskets employed in the radiator were of the preformed type, having a width of ⅜ inch and a thickness of ⅛ inch in the uncompressed state, and composed of 25 durometer silicone elastomer.

The fabrication of the headering arrangement for the above-described radiator was performed in accordance with the following sequence of steps:

a. a ⅛ inch thick silicone rubber 25 durometer gasket was cut to overlay the perimeter of the stacked array;

b. both sides of the gasket were coated, by knife edge application, with a thin coating of XCF3-7024 two-part silicone adhesive (XCF3-7024 silicone adhesive is manufactured by Dow Corning Corporation, Midland, Michigan);

c. the gasket was placed over the perimeter of the stacked array with the adhesive coated surface facing the header tank side of the assembly;

d. the header tank assembly was placed over the stacked array thereby securing the abutting wall portion of the header tank to the gasket by an adhesive bond;

e. the key member was positioned in keyway notches in the fin structure and the integral flange member was secured thereto to cause a 60% compression of the gasket; and f. a suitable time lapse at elevated temperature was provided to "set" the adhesive before exposing the assembly to service conditions.

Subsequent to the above fabrication steps, the assembled radiator was installed in an intermediate size 1975 model automobile having a 365 cubic inch displacement V-8 engine and was road tested under highway and local driving conditions for 10,000 miles with excellent performance.

Although preferred embodiments have been described in detail, it will be appreciated that other embodiments are contemplated only with modification of the disclosed features, as being within the scope of the invention.

What is claimed is:

1. In a heat exchanger assembly comprising: a stacked array of heat exchange channel elements, wherein each channel element is bounded by thermally conductive pressure withholding walls of between 0.003 and 0.150 inch thickness, with a first fluid entrance opening at one end, a first fluid exit opening at the opposite end, and end sections having a cross section bounded by flat side wall portions and edge wall portions and wherein adjacent channel elements in said array are stacked with their flat side wall portions in wall to wall contacting relationship and their edge wall portions in alignment to form a first fluid entrance face at one end of said array and a first fluid exit face at the opposite end of said array, each said face having a perimeter defined by edge wall portion ends of the stacked channel elements and side wall portion ends of the outermost channel elements in said array, and with said pressure withholding walls of adjacent channel elements in the interior of said array being disposed in spaced relationship with respect to each other for flow of a second fluid through said array in the space between said channel elements in heat exchange with said first fluid; inlet header means joined in flow communication with said first fluid entrance face for introduction of first fluid to said channel elements, and outlet header means joined in flow communication with said first fluid exit face for withdrawal of first fluid from said channel elements, each said header means comprising the improvement of a resilient gasket disposed around said perimeter of a said face against the wall portion ends thereof; header tank means enclosing said face, having a wall surface portion abuttingly disposed against said resilient gasket and a structurally integral flange member extending outwardly from said stacked array; and means joining said flange member and another structurally rigid part of said heat exchanger assembly to cause said wall surface portion of said header tank means to bear compressively against said resilient gasket for fluid-tight sealing between the header tank and said stacked array.

2. Apparatus according to claim 1 wherein said another structurally rigid part of said heat exchanger assembly comprises the associated end section of said stacked array.

3. Apparatus according to claim 1 wherein said means joining said flange member and another structurally rigid part of said exchanger assembly comprise mechanical connecting means disposed externally of said stacked array and interconnecting corresponding portions of said flange member of each said header tank means, whereby said another structurally rigid part of said heat exchanger assembly for each said header means comprises said structurally integral flange member of the other said header means.

4. Apparatus according to claim 1 wherein said heat exchanger assembly is constructed and arranged for flow of said second fluid through said array in a direction normal to the longitudinal axis of said channel elements.

5. Apparatus according to claim 1 wherein said resilient gasket is composed of a material having a durometer value of between 5 and 100.

6. Apparatus according to claim 1 wherein the width of aid resilient gasket in the uncompressed state is at least 3/16 inch.

7. Apparatus according to claim 1 wherein said resilient gasket is adhesively bonded to said wall surface portion of said header tank means.

8. Apparatus according to claim 1 wherein said resilient gasket is adhesively bonded to said edge wall portion ends and said side wall portion ends of said perimeter of a said face.

9. Apparatus according to claim 1 wherein said thermally conductive pressure withholding walls are formed of aluminum.

10. Apparatus according to claim 1 wherein said thermally conductive pressure withholding walls are of between 0.003 and 0.020 inch thickness.

11. Apparatus according to claim 1 wherein said pressure withholding walls of each said channel element in the interior of said array have a multiplicity of uniformly disposed outwardly extending projections formed from a portion of the wall surface, said projections having bond-bearing segments at their extremities whereby the facing walls of said adjacent channel elements are mated in supportive relationship with each other.

12. Apparatus according to claim 1 wherein the channel element flat side wall portions disposed in wall to wall contacting relationship are adhesively bonded to each other.

13. Apparatus according to claim 1 wherein said structurally integral flange member of said header tank means comprises said wall surface portion abuttingly disposed against said resilient gasket 14. Apparatus according to claim 1 wherein said resilient gasket is of the formed-in-place type.

15. Apparatus according to claim 14 wherein the thickness of said resilient gasket is less than ¼ inch.

16. Apparatus according to claim 1 wherein said header tank means comprise an inner tank member having a plurality of of spaced openings therein in fluid flow communication with the open ends of said channel elements in said stacked array to provide for uniform distribution of said first fluid.

17. Apparatus according to claim 16 wherein said inner tank member comprises said wall surface portion abuttingly disposed against said resilient gasket.

18. Apparatus according to claim 1 wherein said resilient gasket is of the preformed type.

19. Apparatus according to claim 18 wherein the thickness of said resilient gasket in the uncompressed state in between 1/32 and ½ inch.

20. Apparatus according to claim 18 wherein the thickness of said resilient gasket in the uncompressed state is between 1/16 and 3/16 inch.

21. Apparatus according to claim 1 wherein secondary surface heat transfer fins are joined to the edge wall portions of said channel elements and extend generally outwardly therefrom.

22. Apparatus according to claim 21 wherein said secondary surface heat transfer fins are each provided with a notch in the fin surface extending from the outermost fin edge inwardly toward the channel element joined thereto and with the notches of said fins transversely aligned with respect to the longitudinal axis of said channel elements and wherein said means joining said flange member and another structurally rigid part of said heat exchanger assembly comprise a transversely extended plate member extending inwardly into said notches of said fins and outwardly beyond the outermost edges of said fins and interconnected with said flange member.

23. Apparatus according to claim 22 wherein said notches of said fins are transversely aligned in a plane substantially normal to said longitudinal axis of said channel elements.

24. Apparatus according to claim 22 wherein said tranversely extended plate member comprises an outer end segment crimped around an outer end segment of said flange member to cause said wall surface portion of said header tank means to bear compressively against said resilient gasket.

25. In a heat exchanger assembly comprising: a stacked array of heat exchange channel elements, wherein each channel element is bounded by thermally conductive pressure withholding walls of between 0.003 and 0.150 inch thickness, with a first fluid entrance opening at one end, a first fluid exit opening at the opposite end, and end sections having a cross section bounded by flat side wall portions and edge wall portions and wherein adjacent channel elements in said array are stacked with their flat side wall portions in wall to wall contacting relationship and their edge wall portions in alignment to form a first fluid entrance face at one end of said array and a first fluid exit face at the opposite end of said array, each said face having a perimeter defined by edge wall portion ends of the stacked channel elements and side wall portion ends of the outermost channel elements in said array, and with said pressure withholding walls of adjacent channel elements in the interior of said array being disposed in spaced relationship with respect to each other for flow of a second fluid through said array in the space between said channel elements in heat exchange with said first fliud; inlet header means joined in flow communication with said first fluid entrance face for introduction of first fluid to said channel elements, and outlet header means joined in flow communication with said first fluid exit face for withdrawal of first fluid from said channel elements, said header means comprising the improvement of: a resilient gasket disposed around said perimeter of each said face against the wall portion ends thereof; header tank means enclosing each said face, having a structurally integral flange member extending outwardly from said stacked array, said flange member comprising a wall surface portion abutting disposed against said resilient gasket; and mechanical connecting means disposed externally of said stacked array and interconnecting corresponding portions of said flange member of each said header tank means to bear compressively against said resilient gasket for fluid-tight sealing between the header tank and said stacked array.

26. Apparatus according to claim 25 wherein said resilient gasket is composed of a material having a durometer value of between 20 and 70.

27. In a heat exchanger assembly comprising: a stacked array of heat exchange channel elements, wherein each channel element is bounded by thermally conductive pressure withholding walls of between 0.003 and 0.150 inch thickness, with a first fluid entrance opening at one end, a first fluid exit opening at the opposite end, and end sections having a cross section bounded by flat side wall portions and edge wall portions and wherein adjacent channel elements in said array are stacked with their flat side wall portions in wall to wall contacting relationship and their edge wall portions in alignment to form a first fluid entrance face at one end of said array and a first fluid exit face at the opposite end of said array, each said face having a perimeter defined by edge wall portion ends of the stacked channel elements and side wall portion ends of the outermost channel elements in said array, and with said pressure withholding walls of adjacent channel elements in the interior of said array being disposed in spaced relationship with respect to each other for flow of a second fluid through said array in the space between said channel elements in heat exchange with said first fluid; inlet header means joined in flow communication with said first fluid entrance face for introduction of first fluid to said channel elements, and outlet header means joined in flow communication with said first fluid exit face for withdrawal of first fluid from said channel elements, each said header means comprising the improvement of: a resilient gasket disposed around said perimeter of a said face against the wall portion ends thereof; header tank means enclosing said face, having a wall surface portion abuttingly disposed against said resilient gasket and a structurally integral flange member extending outwardly from said stacked array; secondary surface heat transfer fins joined to said edge wall portions of said channel elements and extending generally outwardly therefrom, wherein said fins are each provided with a notch in the fin surface extending from the outermost fin edge inwardly toward the channel element joined thereto and with the notches of said fins transversely aligned with respect to the longitudinal axis of said channel elements; and a transversely extended plate member extending inwardly into said notches of said fins and outwardly beyond the outermost edges of said fins and interconnected with said flange member to cause said wall surface portion of said header tank means to bear compressively against said resilient for fluid-tight sealing between the header tank and said stacked array.

28. Apparatus according to claim 27 wherein said resilient gasket is composed of a material having a durometer value of between 20 and 70.

* * * * *